United States Patent [19]

Nelsson

[11] 3,962,840

[45] June 15, 1976

[54] CORNER CONSTRUCTION AND CLIP THEREFOR

[75] Inventor: Nels Nelsson, Des Plaines, Ill.

[73] Assignee: United States Gypsum Company, Chicago, Ill.

[22] Filed: Mar. 22, 1973

[21] Appl. No.: 343,659

[52] U.S. Cl. ..... 52/281; 52/714

[51] Int. Cl.[2] ..... E04B 1/00

[58] Field of Search ..... 52/281, 282, 284, 285, 52/326, 359, 482, 495, 714, 715, 489

[56] References Cited

UNITED STATES PATENTS

| | | | |
|---|---|---|---|
| 2,848,758 | 8/1958 | Chisholm | 52/489 |
| 3,363,377 | 1/1968 | Beckman | 52/275 |
| 3,485,001 | 12/1969 | Miller | 52/281 |
| 3,748,815 | 7/1973 | Parker | 52/714 |

FOREIGN PATENTS OR APPLICATIONS

| | | | |
|---|---|---|---|
| 1,249,880 | 11/1960 | France | 52/284 |
| 942,443 | 11/1963 | United Kingdom | 52/495 |

*Primary Examiner*—Frank L. Abbott
*Assistant Examiner*—Carl D. Friedman
*Attorney, Agent, or Firm*—Samuel Kurlandsky; Donnie Rudd; Kenneth E. Roberts

[57] ABSTRACT

A corner construction is provided which utilizes a support having an elongated metallic flange, a back-up clip resiliently engaging the flange, and a pair of panels. One panel has a surface thereof engaging a first portion of the clip and is secured to the flange. The second panel has a surface thereof engaging a second portion of the clip and is secured thereto. An edge of the second panel is in abutting engagement with the first portion of the clip. The clip is concealed by the first and second panels which are arranged in angular relation.

8 Claims, 4 Drawing Figures

FIG. 1
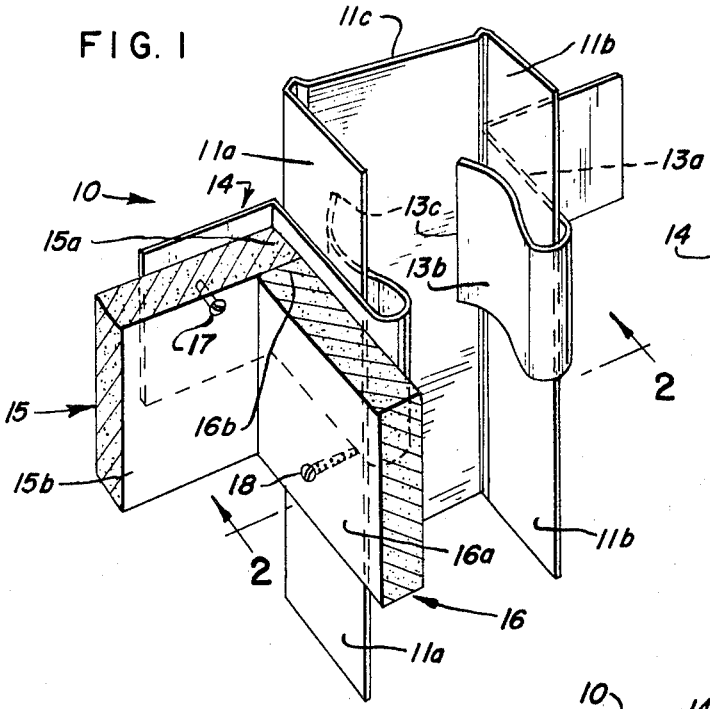
FIG. 4
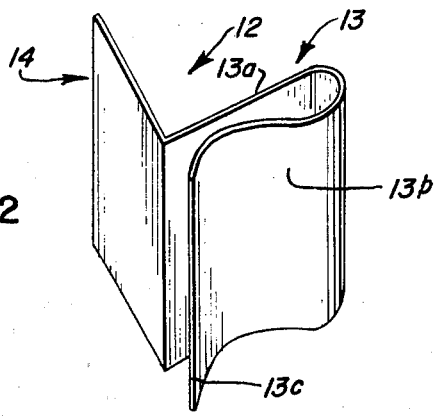
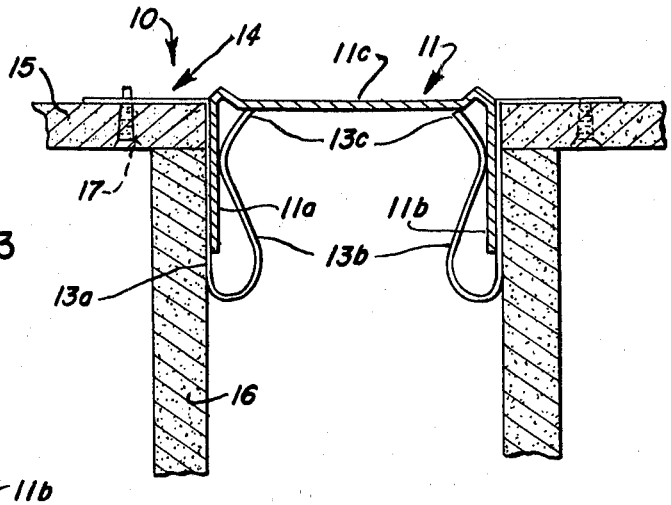
FIG. 3
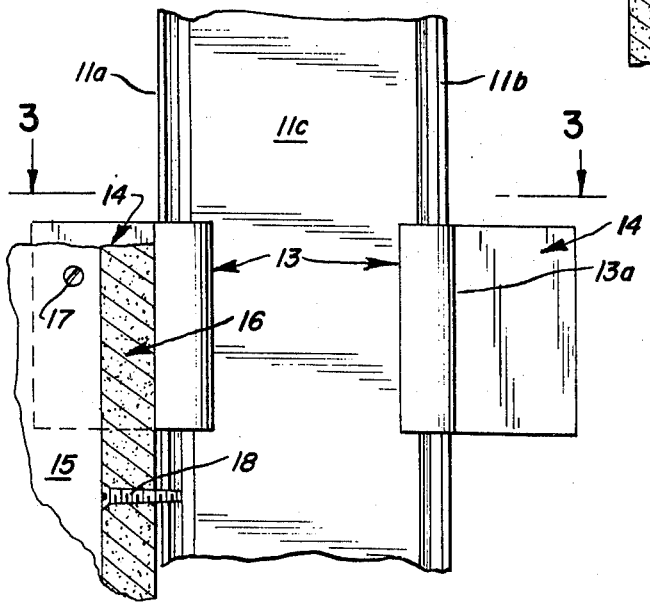
FIG. 2

CORNER CONSTRUCTION AND CLIP THEREFOR

BACKGROUND OF THE INVENTION

Various interior corner constructions have heretofore been provided; however, in instances where metallic supports, such as studs or joists are used, a problem often arises with regard to providing the necessary back-up support for one of the panels comprising the corner construction. Because the conventional metallic support normally provides back-up for only one of the panels, it is necessary for the erector to utilize a second support or some other means to provide the necessary back-up clip of unitary construction which may be tion becomes time-consuming, expensive, awkward and oftentimes detracts from the esthetic appearance of the interior corner.

Thus, it is an object of the invention to provide a corner construction which may be readily erected, is inexpensive, and yet, will provide adequate back-up for the various panels comprising said corner.

It is a further object of the invention to provide a back-up clip of unitary constructon which may be readily mounted on a conventional metallic support without requiring screws, nails, or the like, and may be positioned at any desired location on the support.

It is a still further object of the invention to provide a back-up clip which is fully concealed when the corner is set up.

It is a still further object of the invention to provide a back-up clip which is of a simple, inexpensive design and can be readily applied to a conventional metallic support without requiring tools or special dexterity on the part of the erector.

Further and additional objects will appear from the description, accompanying drawing, and appended claims.

In accordance with one embodiment of the invention, a corner construction is provided which includes an elongated metallic supporting flange, a pair of panels engaging one another and arranged in angularly disposed relation, and a unitary clip resiliently gripping the flange and providing back-up for at least one of the panels. The clip has a first portion with a segment thereof disposed between the flange and a surface of the first panel, and a second portion which extends angularly outwardly from the first portion segment and is engaged and concealed by the second panel.

DESCRIPTION

For a more complete understanding of the invention, reference should be made to the drawing wherein:

FIG. 1 is a fragmentary, perspective view taken from below of one form of the improved corner construction with portions of the ceiling and wall panels thereof removed so as to reveal various components comprising the corner construction;

FIG. 2 is a sectional view taken along line 2—2 of FIG. 1;

FIG. 3 is a sectional view taken along line 3—3 of FIG. 2; and

FIG. 4 is a perspective view of one form of the back-up clip shown in FIG. 1.

Referring now to the drawing and more particularly to FIGS. 1–3, one form of the improved interior corner construction 10 is shown. The illustrated corner construction is suitable for use where two vertical walls or one wall and a ceiling define the corner in question. For purposes of facilitating understanding the invention, the improved corner construction having a vertical wall and a horizontal ceiling, will be described; however, it is to be understood, of course, that the invention is not intended to be limited thereto, but may be utilized where two vertical walls are involved.

The corner construction 10 includes an elongated horizontally extending metallic runner 11 of conventional, channel-shape cross-sectional configuration. The ends of the runner are anchored in place by suitable, well-known means. The runner 11 includes a pair of depending flanges 11*a* and 11*b* which have corresponding edges thereof interconnected by a base portion 11*c*. The width of the base portion may vary from 1-⅝ inches to 3-⅝ inches and will depend upon the characteristics of the particular installation. Where the corner construction involves only vertical walls, a vertically disposed, metallic channel-shape stud may be substituted for the horizontal runner. Resiliently gripping the depending flanges 11*a* and 11*b* of the runner are clips 12. The clips are disposed in longitudinally spaced relation along each runner flange. Each clip is of unitary construction and has a similar cross-sectional configuration which includes a first portion 13 adapted to resiliently grip the runner flange 11*a* or 11*b*, and a second portion 14 which is connected to the first portion and projects laterally outwardly therefrom and away from the engaged runner flange. The first portion 13 of each clip comprises a first segment 13*a* which is adapted to engage the outer surface of the runner flange, and a second segment 13*b* which is connected to one edge of the first segment and is in substantially fold-back relation therewith. The second segment 13*b* is bent slightly so as to assure resilient contact thereof with the interior, or opposite surface of the runner flange, and to also facilitate mounting of the clip on the flange. Segment 13*b* is preferably of such a dimension that the free edge 13*c* thereof will engage the base portion 11*c* of the runner 11.

The runner 11 and the clips 12 are concealed by panels 15 and 16, when the corner construction 10 is erected. The panels 15 and 16 are preferably of like construction and may be gypsum wall board commonly utilized in either dry wall or plastered wall construction. In certain instances, the panel 15 may be of an acoustical character.

In erecting the corner construction 10, the ceiling panel 15 is initially positioned against the laterally extending clip portion 14 so that the narrow edge 15*a* of the panel will abut the outer segment 13*a* of the clip 12 which had previously been mounted on the runner flange 11*a*. While panel 15 is so positioned, it may be secured to clip portion 14 by one or more self-tapping screws 17 or some other suitable means. Because of the engagement between the base portion 11*c* of the runner 11 and the edge 13*c* of the clip, the latter will remain in a fixed relative position with respect to the runner 11 when the screw 17 is being threaded through the panel 15 and into clip portion 14.

Once panel 15 is secured in place, vertical panel 16 is then moved into position so that segment 13*a* of the clip is snugly sandwiched between the runner flange 11*a* and the inner surface 16*a* of the panel 16 and the narrow edge 16*b* of the panel abuts the exposed surface 15*b* of the previously mounted panel 15. Self-tapping screws 18 or the like are then used to secure panel 16 in place, see FIG. 2. The screws 18 are threaded into the flange 11*a* or 11*b* of the runner.

Where a vertically disposed stud, not shown, is substituted for runner 11, the same procedure as described above is followed with respect to mounting clips on the stud, and the panels on the clips and studs.

Thus, a corner construction and clip used therein have been provided wherein erection of the corner construction can be readily and easily accomplished and no special tools or erectors possessed of special talents are required. The clips used in the construction are of simple, inexpensive design and in no way detract from esthetic appearance of the finished construction.

I claim:

1. An interior corner construction comprising an elongated metallic supporting flange having an inner surface and an outer surface; a first panel having a broad surface with a portion of the outer surface thereof in proximate side-by-side relation with the outer surface of said flange; a second panel angularly disposed relative to said first panel, one of said panels having a narrow edge thereof in abutting relation with an exposed surface of the other panel, said supporting flange being positioned external of the angle included between said first and second panels; a clip resiliently mounted on said supporting flange and in contact with said first and second panels; said clip including a first portion in resilient gripping relation with the inner and outer surfaces of said flange, a first segment of said clip first portion being sandwiched between the outer surface of said first panel and the outer surface of said flange and a second segment of said clip first portion being bent over said first segment and engaging the inner surface of said flange to provide said resilient gripping relation, and a second portion of said clip being planar with free edges and extending angularly from the first portion first segment and away from said flange in contact engagement with the outer surface of said second panel; and means for securing said second panel to the second portion of said clip in contact therewith, whereby said second panel conceals said clip.

2. The corner construction of claim 1 wherein said flange forms a leg of an elongated channel-shaped support; the second segment of the first portion of said clip in resilient engagement with the inner surface of said flange.

3. The corner construction of claim 2 wherein said elongated channel-shaped support comprises a vertically disposed, metallic stud, and the second segment of said clip is provided with a free edge in abutting engagement with a base of the channel-shaped support.

4. The corner construction of claim 1 wherein said flange extends horizontally, said first panel forms an upright wall, and said second panel forms a horizontal ceiling.

5. The corner construction of claim 1 wherein said flange extends vertically, and said panels form angularly disposed upright walls.

6. The corner construction of claim 1 wherein said first panel is secured to said flange, and said second panel is secured to the second portion of said clip.

7. The corner construction of claim 1 wherein said clip is of unitary construction, and the second portion thereof and the segment of said first portion are disposed in substantially right angle relation.

8. The corner construction of claim 1 wherein said second panel is provided with a narrow edge disposed in abutting relation with the segment of said clip first portion.

* * * * *

UNITED STATES PATENT OFFICE

CERTIFICATE OF CORRECTION

Patent No. 3,962,840 Dated June 15, 1976

Inventor(s) Nels Nelsson

It is certified that error appears in the above-identified patent and that said Letters Patent are hereby corrected as shown below:

Column 1, line 14, after "back-up" delete "clip of unitary construction which may be";

Column 1, line 15, delete "tion" and insert -- for the second panel as well. Such an operation --.

Signed and Sealed this

Seventh Day of September 1976

[SEAL]

*Attest:*

RUTH C. MASON
*Attesting Officer*

C. MARSHALL DANN
*Commissioner of Patents and Trademarks*